US009969156B2

(12) United States Patent
Duss et al.

(10) Patent No.: US 9,969,156 B2
(45) Date of Patent: May 15, 2018

(54) TRANSVERSE SHEET WITHDRAWAL BRAKE

(71) Applicant: Mueller Martini Holding AG, Hergiswil (CH)

(72) Inventors: Hanspeter Duss, Buchs (CH); Christian Troxler, Rain (CH)

(73) Assignee: MUELLER MARTINI HOLDING AG, Hergiswil (CH)

( * ) Notice: Subject to any disclaimer, the term of this patent is extended or adjusted under 35 U.S.C. 154(b) by 84 days.

(21) Appl. No.: 14/872,985

(22) Filed: Oct. 1, 2015

(65) Prior Publication Data

US 2016/0096359 A1 Apr. 7, 2016

(30) Foreign Application Priority Data

Oct. 1, 2014 (CH) ..... 1501/14

(51) Int. Cl.
*B41F 21/00* (2006.01)
*B65H 45/18* (2006.01)
*B65H 9/14* (2006.01)

(52) U.S. Cl.
CPC ..... *B41F 21/00* (2013.01); *B65H 9/14* (2013.01); *B65H 45/18* (2013.01); *B65H 2301/4492* (2013.01)

(58) Field of Classification Search
CPC ..... B65H 2301/164; B65H 2301/17; B65H 2301/45; B65H 2301/452; B65H 2301/4521; B65H 2404/72; B65H 2407/30; B65H 45/18; B65H 9/14; B65H 2301/4492; B41F 21/00
See application file for complete search history.

(56) References Cited

U.S. PATENT DOCUMENTS

| | | | | |
|---|---|---|---|---|
| 4,289,494 | A | 9/1981 | Bolza-Schunemann | |
| 5,718,176 | A | 2/1998 | Stephan | |
| 2002/0140151 | A1 | 10/2002 | Couturier | |
| 2004/0089997 | A1 | 5/2004 | Klein et al. | |
| 2004/0124579 | A1 | 7/2004 | Schafer et al. | |
| 2005/0230448 | A1* | 10/2005 | Miura | B65H 20/20 226/101 |
| 2006/0244204 | A1 | 11/2006 | Bottger et al. | |
| 2007/0001385 | A1 | 1/2007 | Muller et al. | |
| 2008/0013991 | A1* | 1/2008 | Amico | G03G 15/2028 399/328 |
| 2008/0088081 | A1 | 4/2008 | Miwa et al. | |
| 2009/0230618 | A1 | 9/2009 | Holzschneider et al. | |

(Continued)

*Primary Examiner* — David Banh
(74) *Attorney, Agent, or Firm* — FisherBroyles, LLP; Robert Kinberg

(57) ABSTRACT

A method for operating a device that applies a force to a print sheet during a folding operation, wherein the print sheet is in a specified starting position prior to the folding operation. Braking-force triggering pulses are directed toward the print sheet to counter the acceleration of the print sheet in the starting phase of the folding operation and/or to counter fluttering movements that occur during the intake of the print sheet. The pulses exert an intermittent, uniform or oscillating force onto at least a section of the print sheet. The pulses are controlled by a control unit which operates based on control profiles resulting from queried operating parameters and/or based on stored control profiles.

28 Claims, 5 Drawing Sheets

(56) References Cited

U.S. PATENT DOCUMENTS

| | | | | |
|---|---|---|---|---|
| 2013/0142545 | A1* | 6/2013 | Kimura | G03G 15/757 399/167 |
| 2014/0026772 | A1 | 1/2014 | Wolf et al. | |
| 2015/0102554 | A1 | 4/2015 | Ansermot | |
| 2016/0096358 | A1* | 4/2016 | Duss | B65H 9/14 101/407.1 |

* cited by examiner

TRANSVERSE SHEET WITHDRAWAL BRAKE

CROSS-REFERENCE TO RELATED APPLICATIONS

Priority is claimed of Swiss Patent Application No. 01501/14, filed Oct. 1, 2014, the disclosure of which is incorporated herein by reference in its entirety.

BACKGROUND OF THE INVENTION

Technical Field

The present application relates to a method and a device which, following the braking and positioning of a print sheet in a processing machine, is designed to activate, with the aid of at least one braking-force generating mechanism an additional transverse sheet brake that is connected to the operation of a downstream-arranged processing station.

The application thus refers to the production of folded print sheets in a folding apparatus, wherein the folding apparatus is typically equipped with a cross-folding device and/or a longitudinal folding device. The print sheets are typically processed starting with a paper roll, wherein this roll is first printed on in a printing press (digital or offset) and is then guided inline into the folding apparatus. Already printed paper rolls can also be supplied directly to the folding apparatus. The loose sheet in the form of a single sheet can furthermore be supplied via the printing press to the folding device, either printed or not printed.

For this, it must be ensured that the braking of the print sheet leads to a secure positioning before the print sheet can be supplied to the folding operation, thus showing an obvious interdependence between braking and positioning and folding operation.

Prior Art

The folding of the different substrates (papers), in particular the longitudinal folding, is especially challenging from a process-technical view since the print sheets coming from the feed device must be redirected with a sword by 90° and must be supplied to a pair of folding rollers. Before the sheet sections are supplied with the aid of the sword or other folding device to the folding roller pair, the sheet section, which typically arrives from a cross-folding device, must be slowed down within a very short time (a few milliseconds or fractions of milliseconds) from the feeding speed to a speed of 0. With the presently known longitudinal folding devices, this is achieved either with a sheet stop or a combination of a sheet stop and a brush.

The purpose of the brush is to brake and smooth the incoming sheet sections over the width of the brush. For the most part the sheet sections arrive in the longitudinal folding device with the folding edge in the lead (cross fold). However, non-folded (meaning without cross fold) sections can also be supplied to the longitudinal folding device.

The longitudinal folding process is basically prior art. The main problem with the print sheet deflection into the folding rollers is above all the stopping of the print sheets at the so-called sheet stop, wherein the complete delay energy is generated abruptly at the sheet stop. This leads to the print sheet being compressed in the region of the sheet end stop or, with rigid print sheets, it results in the conversion of a portion of the energy in the form of bouncing back of the print sheet.

The compressing of the print sheets can result in damage to the folding edge and thus to poor quality products, depending on the paper type and the speed. During the bouncing back, the print products can furthermore turn slightly as compared to the optimum geometric position. With the following insertion point for the folding sword, this results in slanted or parallel folds. To reduce or eliminate these negative effects, a great number of different measures have been proposed which represent components of the prior art.

For example, the braking brush or brushes are located in the region in front of the sheet stop and must respectively be adjusted to the product thickness. The disadvantage of this solution is that the braking brushes are subject to strong mechanical wear and the adjustment to the paper thickness is generally very involved. Also, the supplying upper belts can run only to the end of the print sheet section. A bouncing back is thus prevented or the product is again returned to the end stop. However, damage to the print sheet at the end stop is not prevented in this way. Also conceivable is a combination with the above solution. Additional known systems are actively controlled braking devices which slow down the print sheet at the end so that the print sheet only needs to align itself with the end stop.

A system for braking paper sheets is known from the German patent document DE 199 21 169 C2. With this system, the products are advantageously slowed and stopped at the back, so that they can be stretched and rest flat on the base, e.g. a folding table. The system has a compact and simple design with few components and is easy to control. According to the description, the system can be used as a sheet brake on folding tables, as a brake for slowing-down stations, or in front of the paddles of paddle wheels, so that the products can be processed further without damage. By means of a support, paper sheets are conveyed via transport belts that are not shown therein, for example to a folding table for printing presses. These paper sheets can be products cut from paper webs in transverse-cutting devices which can be non-folded, or single-folded, or multiple folded and can be gathered or non-gathered products. A carrier extending above the paper movement direction is attached to a frame. At the end facing away from the frame, an electromagnet is arranged on the carrier. An armature moves inside its coil body, preferably perpendicular to the movement direction and surface of the paper sheets. At the end directed toward the movement track, an armature is provided with a brake shoe with thereto attached brake lining. A spring element can be used to move the brake shoe with spring action, e.g. a leaf spring of resilient steel or plastic material, which is connected to the carrier through a receptacle. Also conceivable would be a screw spring which is directly accommodated by the armature and supports itself on the housing for the electromagnet, as well as on an armature indention. By electrically triggering the electromagnet, a magnetic flux field is generated, the force effect of which causes the armature to press the paper sheet via the brake shoe with lining against another brake lining that is fixedly attached to the support.

German patent document DE 43 07 383 A1 discloses a system for stopping sheets, in particular paper sheets. The sheets are successively transported to a braking system by a fast-moving series of belts, consisting of several spaced-apart, parallel-arranged lower belts and upper belts. While the discharge-side deflection rollers for the lower belts are positioned in front of the braking system, the upper belts extend further into the region of the braking system. The braking system consists of a guide metal extending over the working width, which is arranged below the intake plane. At a track discharge end of the sheet metal, a slot nozzle is arranged through which compressed air is blown counter to the sheet movement direction across the top of the guide sheet and is directed upward by the sheet end that is curved upward. The air flow generates a vacuum or low pressure which pulls the back edges of the sheets downward and simultaneously slows down the sheets. The air nozzle is followed directly by a circulating overlap blanket, having the width of the machine, which moves at a slower deposit speed. The sheets deflected downward by the airflow from the nozzle detach themselves from the upper belts and are deposited on the blanket. In the process, the front edge of the following, not yet decelerated sheet, slides over its back edge and an overlapping flow is created which is then transported further at a slower deposit speed.

SUMMARY OF THE INVENTION

Based on a method and a device of the aforementioned type, it is an object of the invention to first completely stop print sheets arriving at a high speed, at a precise position and such that they are stable before these print sheets are supplied to the downstream-arranged further processing station, that is to say the means of this processing station should be able to securely grip the print sheets.

It is thus established that at least for the present case, the precisely positioned stopping of the print sheet is closely connected to the further processing, for which the precise positioning represents a precondition per se and also otherwise represents a quality-ensuring measure for the further processing.

In some cases, however, the precisely positioned braking of the print sheets only represents an intermediate step which is not directly operatively connected to the following processing, but nevertheless depends on a precise positioning.

In contrast, cases can also occur for which the print sheets are already present in a stable position and for which the further processing of the individual sheets is preferably connected to a folding operation.

Regardless of which final purpose is served with this precisely positioned braking, it is an object of the invention to prevent on the one hand any damage to the print sheet, so that it is always precisely positioned and, on the other hand, to make sure that a secure folding operation with clock speed can take place.

Starting with a preferred variant, the print sheets are supplied to a folding device following the stopping in the precise position, wherein the measures according to the invention are focused on the precisely positioned stopping of the print sheet as well as its further processing.

The invention propose a qualitative and economic improvement of the prior art with a device and a method for achieving a precisely positioned stopping of the print sheet in the preliminary stage. According to the invention, a so-called transverse sheet brake is subsequently used which actively accompanies the folding operation, so that the braking-force triggering pulses also effect the dynamic of the print sheet before and/or after the aforementioned operation.

The precisely positioned stopping of the print sheet is a qualitative and economic technical improvement, relating to a method and device that uses preferably pneumatic means for this stopping operation. The pneumatic means are braking force triggering air pulses, wherein the braking force exerted onto the print sheet can also occur indirectly, meaning preferably by using mechanical elements which are admitted by the air pulses and then further transmit the braking force to the print sheet.

In principle, the precisely positioned stopping of the print sheet in the feeding direction can at least in part be achieved with a vacuum that acts upon the print sheet and can be generated by suitable measures within the table-type support which affects the print sheet. As a result, the friction between the surface of the table-type support and the underside of the print sheet is increased such that this frictional force can advantageously also be used for precisely adjusting an exact final positioning for the print sheet.

The two braking forces, meaning the braking-force triggering pulses as well as the increase in the friction caused by vacuum pressure onto the print sheet can be controlled either interdependent or independent of each other, wherein the braking-force share of the two forces can be changed and/or adapted for each case.

Of course, additional friction can also be achieved with at least one mechanically activated element, which can also be used for the precise adjustment in addition to the braking-force triggering pulses caused by pneumatic means, wherein this mechanical element can be provided with an autonomous control or can be activated with a pneumatic force alone.

As a result of the aforementioned effects on the print sheet, a continuous optimization of the effective braking and frictional forces can be achieved in that a controlled action is used which includes all of the aforementioned influencing options.

This type of operation, which calls for the integration of the direct and/or the indirect braking as well as the braking by triggering additional frictional effects on the print sheet is particularly advantageous if the print sheets are to be supplied before or after the folding operation to an overlapping flow or to achieve a corresponding removal from the overlapping flow.

Thus, according to the invention several options exist for the precisely positioned stopping of the print sheet:

1. The precisely positioned stopping of the print sheet is achieved solely through braking-force triggering pulses generated by pneumatic means;
2. The precisely positioned stopping of the print sheet is achieved optionally through activating an additional braking force based on friction, caused by the generating of a vacuum acting upon the print sheet and/or the use of at least one mechanical element.

Concerning the positioning of the print sheet, meaning the precisely positioned stopping within the meaning of a standstill at a precise point, the following directions can be provided:

The precisely positioned braking within the meaning of a standstill at a precise point for the print sheet is managed solely with braking-force triggering pulses and/or the introduction of additional braking forces (directly). This can be achieved with the latter means, for example, by generating a vacuum acting upon the print sheet and/or the use of at least one mechanical element.

The precisely positioned braking within the meaning of a standstill of the print sheet at a precise point can be achieved with braking-force triggering pulses and/or the introduction of additional braking forces, as described in the above, which ensure that the feeding speed of the print sheet relative to the specified end position is slowed down enough, so that it is nearly zero or tends toward zero. The final standstill at a precise point for the print sheet is determined by taking into account an end stop at which the print sheet arrives with a speed remnant (indirectly). Since this speed remnant is microscopically low, there is no danger that the front edge of the print sheet in the feeding direction is damaged when it impacts with the end stop or could bounce back or spring back from the end stop surface. This soft end positioning for the print sheet additionally has the advantage that the sheet can adapt completely to the contour of the end stop, thereby resulting in a maximized precise orientation of the print sheet relative to the stop surface.

The following is relevant in this case: approximately 10 cm in front of the end stop, the speed of the print sheet is slowed down with the aid of a print sheet braking device, enough so the sheet comes to rest against the end stop with only a slight amount of kinematic residual energy, wherein the speed of the print sheet on impact is <1 m/s. Given this end speed, no damage to the print sheet can occur and the print sheet also does not bounce back because of an excessively high impact speed.

The course of the delay in the feeding speed for the print sheet can advantageously be computed based on an e-function or quasi e-function, wherein a truncating of the original course by another mathematical course is also possible. Truncating is understood to mean the cutting off or separating of something, mostly in an imaginary sense. Cited as an example could be that the course of the e-function is no longer continued after a specific point and another mathematical function is used to continue the braking course.

In both above-described cases it applies that the dynamic of the braking-force triggering measures must take into consideration the manner in which the print sheets are transported. If transport belts are used for the transport, then the control of all braking-force triggering measures must be operatively connected to the kinematic force exerted by the transport belts onto the print sheets. Thus, the braking effect of the provided means in principle should not collide with the kinematic forces of the transport belts, wherein it is possible for specific constellations that an at least partial super-imposition of both forces (braking force and transport force) is purposely desired.

With respect to the technical nature of the braking forces and their introduction and use according to the invention for a positioning of the print sheets in feeding direction, the following connections are obvious:

a) Intermittent, uniform or oscillating braking-force triggering pulses which convert the braking force directly, semi-directly or indirectly can be applied to the print sheet. These types of pulses can advantageously be generated with the necessary intensity and force with the aid of an air supply.

b) The braking-force triggering pulses can advantageously be generated with pneumatic means or friction-triggering elements, wherein autonomously driven electronic or hydraulic elements can also be used. These last-mentioned elements can furthermore exert a direct or indirect braking force on the print sheets.

c) The pneumatic braking-force triggering pulses are preferably generated by at least one air stream that is focused toward the print sheet or at least one air blast that blows onto a flexible element, arranged intermediary above the print sheet, wherein this element takes the form of a lever that yields directly or is movable via a bearing;

d) If the lever effect of the aforementioned element is converted directly, it is an advantage, for example, if this element is embodied as a fiber-reinforced textile-type belt, thus resulting in flexibility in dependence on its spring constant.

e) With the use of a lever, if the air pulse acts upon a lever arm, the normal force and consequently the resulting braking force can be increased owing to the lever principle.

f) With the above-described measures, even asymmetrically composed folded sheets can advantageously be processed, starting with the premise that these folding sheets have the disadvantage of different values for the weight on the left and on the right. According to the invention, the force of the air pulse and consequently also the resulting braking force can thus be adjusted for this purpose with automatic pressure controllers. The necessary adjustment values for this are automatically calculated by the control and/or the super-imposed process control system.

g) The braking-force triggering pulses can simultaneously or at different points in time affect with the same or different braking force variables a front and/or a back edge of the print sheet in the feeding direction, thereby simultaneously achieving a smoothing and/or stretching of the print sheet.

Accordingly, the device for braking and positioning a print sheet in a processing machine is provided with means which exert along the feeding direction for the print sheet a pneumatic and/or mechanical braking-force effect and/or a different frictional force acting upon the print sheet.

The precise positioning of the print sheet must therefore be focused on the operation of a downstream-arranged processing station, meaning that the positioning must be tightly connected to the operational requirements of the downstream processing station which, for the following consideration, is a folding operation.

It can be determined that when using the above-explained measures, the print sheet arriving at high speed is slowed to 0 with respect to the exact positioning (speed vector in feeding direction=0), so that the print sheet at standstill can be gripped by the means of the following folding device which operates with a folding roller pair.

The air pulse applied perpendicularly to the print sheet generates a normal force which, as the resulting force, is transmitted by the print sheet directly to the support surface. The force composed of the normal force and the friction coefficient that is effective between the print sheet and the support surface in most cases ensures a stabilizing effect for the downstream folding operation.

That is always the case if the air pulses acting upon the print sheet are as efficient as possible, so that the frictional coefficient between print sheet and support surface can be increased if the above-described braking effects are added, as needed, by purposely decelerating the print sheet, wherein it is always in the foreground that the supplied print sheet should not have any damage or sustain other impairment to the print image as a result of the precisely positioned stopping.

Even if the print sheet is present while stopped precisely positioned at the optimal location, forces can be released during the further processing in the folding device, in particular after the intake rollers have gripped the print sheet, which can result in a hard to control fluttering movement of the print sheet. As a result, the folding quality can be affected directly, especially if this quality plays an important role in the further processing of the folded print sheet.

This problem is remedied according to the invention by advantageously directing air-supported pulses toward the print sheet which cause a super-imposed force effect during the complete folding process, in particular to counter the acceleration of the print sheet during the starting phase of the folding operation or thereafter if fluttering movements occur during the intake of the print sheet.

According to the invention, it can thus be achieved that the pulled-in print sheet is purposely stopped with the aid of the transverse sheet brake and/or is calmed relative to the fluttering movement.

With a tendency for these fluttering movements to occur during the intake of the print sheet, the same principle can be used by applying the transverse sheet brake early and across the wide width of the print sheet to start a neutralizing of this fluttering movement when it develops.

These superimpositions apply to the longitudinal folding operation as well as to the cross-folding operation and also depend on whether a mechanical or pneumatically operated folding device is used.

Intermittent, uniform or oscillating braking-force triggering pulses can be provided continuously for this during the intake of the print sheet.

If, based on a control/regulation, a dynamic introduction of braking forces on the print sheet are needed during the folding operation, corresponding fast-switching valves can be used to generate the relatively short air pulses, wherein these valves are tested elements and are operatively stable, in contrast to braking brushes according to the prior art which must always be adjusted precisely to the paper thickness and are also constantly subjected to wear. A measure of this type, using braking brushes, would not be feasible for stopping the print sheet during the folding process.

The invention thus also relates to a high degree to a method for operating a device having a braking effect on a print sheet during a folding operation, wherein the print sheet is in a specified starting position before reaching the folding operation.

Braking-force triggering pulses are thus directed toward the print sheet to counter the acceleration of the print sheet that occurs in the starting phase of the intake for the folding operation and/or to counter the fluttering movements that occur during the folding operation, wherein the effect of these pulses is intermittent, uniform or oscillating and affects at least a section of the print sheet surface. The pulses are controlled by a control unit which, in turn, is driven by changeable control profiles resulting from the queried operating parameters and/or based on stored control profiles.

A further component of the invention is that the method ensures the starting position of the print sheet through the stopping operation, wherein at least one means is provided in feeding direction for the print sheet which exerts a braking effect on the print sheet, so that the positioning of same is ensured in connection with the operation of a downstream arranged processing station. A first means is operated with pneumatic braking-force triggering pulses that act upon the print sheet.

At least a second means is operated to provide the braking-force generating frictional force acting upon the print sheet, wherein the first and/or second means generate intermittent, uniform or oscillating braking forces acting upon the print sheet, wherein these braking forces are controlled by a control unit which is operated based on changeable control profiles resulting from queried operating parameters and/or are based on stored control profiles.

The method according to the invention can also be operated in combination, on the one hand braking and positioning the print sheet in feeding direction and, on the other hand, delaying the print sheet in the starting phase of the intake for the folding operation and/or to counter the fluttering movements of the pulled in sheet which occurs during this process. The method includes the following steps:

Owing to the specified production data such as folding pattern, paper weight, paper width and cut-off length, the air pressure needed for the braking is computed and the information transmitted to the automatic pressure controller, taking into consideration that the print sheet has different values on the left and right side, depending on the folding pattern.

Owing to the specified production data such as folding pattern, paper weight, paper width and cut-off length, the air pressure needed for the braking is furthermore computed for decelerating the print sheet during the intake for the folding operation and/or to counter the fluttering movements that occur with the drawn-in print sheet, and the information is transmitted to the automatic pressure controller, taking into consideration that the print sheet has different values for the left and the right side, depending on the folding pattern.

The pressure reservoir located in the flow direction in front of the switching valve is filled with the aid of a pressure regulator to the computed pressure.

The print sheet arriving at/fed to the folding region is detected along the back edge by a light barrier, wherein this light barrier simultaneously functions to synchronize the folding sword, and wherein the light barrier detects irregularities in the transport of the print sheet and compensates for these via the control unit.

Owing to activated trigger signal, a signal for activating the pneumatic switching valve is triggered, taking into consideration the dead time and speed compensation.

Following this, the air stored in the pressure container is released abruptly, whereupon the air nozzle emits a pulse-type blast of air.

The released air blast then acts directly upon the print sheet or indirectly onto a lever which transfers the force triggered by the air blast onto the print sheet.

During the feeding operation and/or during the folding process, the print sheet is pressed against a table-type support and generates a braking force for the print sheet as a result of friction.

A braking force can be exerted as needed onto the back edge of the print sheet, either simultaneously or with a time delay, thus resulting in a stiffening of the print sheet due to the material stretching that is triggered by the braking effect. However, it must be ensured that these air pulses do not lift the edge at the end of the print sheet off the table-type support as a result of air blown underneath.

The stopping point is selected such that the print sheet is stopped securely at the precise point. If the final positioning is achieved through an end stop, it must be ensured that the print sheet rests against the end stop, or that the folding sword takes over the print sheet.

Following the release of the air pulses, the pneumatic switching valve is closed immediately and the print controller then again fills the air reservoir up to the specified pressure level, so that it is available for the following cycle.

The essential advantages of the invention can be summarized point by point as follows:

1. As compared to traditional solutions, the invention is distinguished in that it uses practically no mechanically moving parts and is therefore not subject to wear, not even at high clock speeds.
2. By using a transverse sheet brake that operates before and/or during the folding operation, the print sheet is acted upon so as to ensure quality.

3. The fast-switching valves needed for generating the short air pulses are tested elements and accordingly are operatively stable, in contrast to the braking brushes according to the prior art which must always be adjusted precisely to the paper thickness of the print sheets and thus are subjected to continuous wear.
4. It is furthermore advantageous that the measures according to the invention for achieving a precisely positioned stopping, within the meaning of a standstill at the precise point for the print sheet, are not restricted by the space conditions in the region of the folding sword, which are minimized per se, thereby ensuring easy access to correct a problem in case of a jam.
5. The print sheets are not subjected to any damage during the described operations.

BRIEF DESCRIPTION OF THE DRAWINGS

The invention is explained in the following with further detail and with reference to the drawing, to which we expressly refer for all details not emphasized further in the description. All elements not absolutely necessary for the direct understanding of the invention were omitted. The same elements in different figures are provided with the same reference numbers, The drawing shows in.

DETAILED DESCRIPTION OF THE INVENTION

Figure 1:
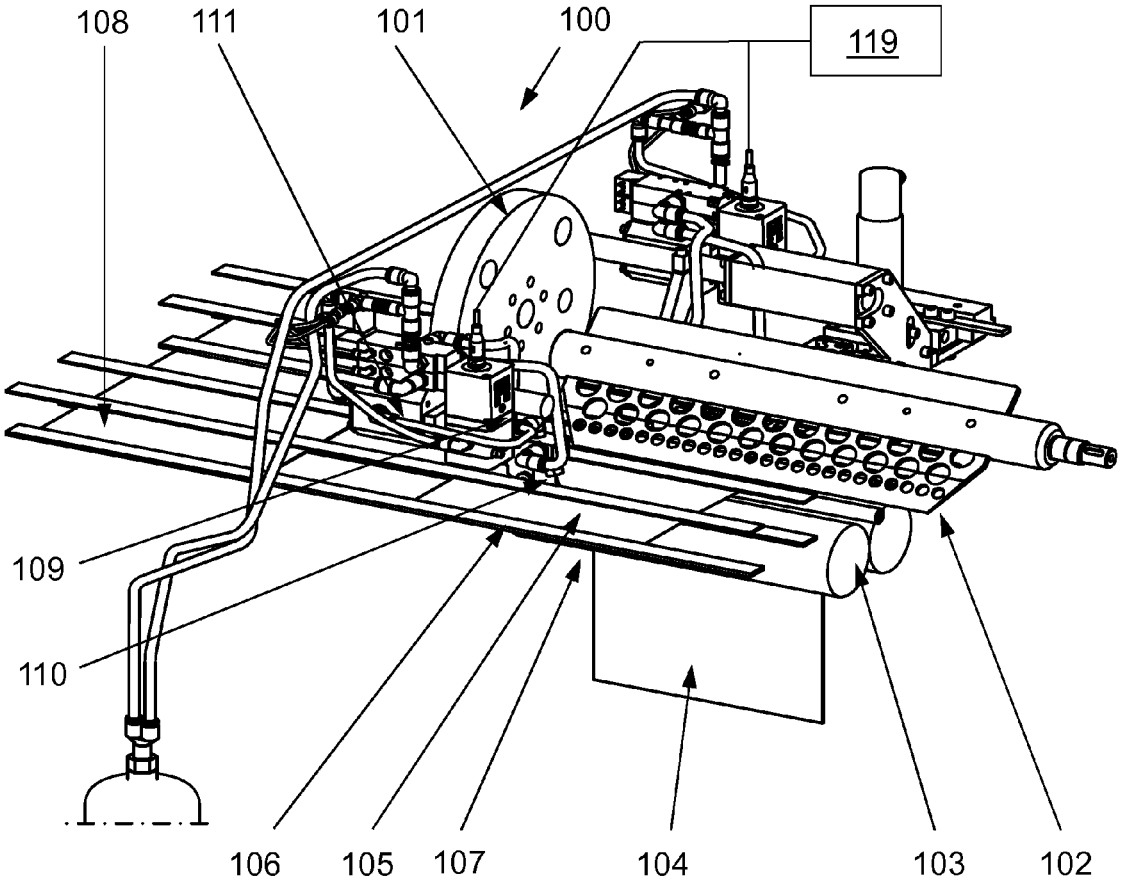
FIG. 1 is a perspective schematic showing a complete overview of a longitudinal folding device, including a transport belt for supplying print sheets according to an embodiment of the invention.

FIG. 1 shows the area surrounding a longitudinal folding device 100, which essentially includes a longitudinal folding device 101 which can be operated using a folding sword 102. FIG. 1 also shows the configuration of the folding roller pair 103. The operation of the longitudinal folding device 101 is illustrated with a print sheet 104 which is folded in a longitudinal direction. Of course, the print sheet can also be folded inside a cross-folding device, not shown further herein, wherein this device is operatively connected to the shown longitudinal folding device 101 or can be operated as an autonomous unit. A print sheet 105 is supplied via transport belts 106 and is stopped in the precise folding position 107, wherein the table-type support is not shown in further detail. For a better understanding reference is made to FIG. 6 which illustrates the table-type support **106*a*. FIG. 1 furthermore shows a trailing print sheet 108, designed to illustrate a clocked operation in the longitudinal folding device 100**.

The operative connection between such a longitudinal folding device and a precise positioning of the print sheet 105 takes place as follows:

Based on the specified production data such as folding pattern, paper weight, paper width and cut-off length, the air pressure needed for the braking is computed and the information sent by a control unit 119 to the automatic controller, taking into consideration that depending on the folding pattern, the print sheet has different values on the left and on the right side.

Furthermore, based on the specified production data such as folding pattern, paper weight, paper width and cut-off length, the air pressure required for the braking is computed for decelerating the print sheet 105 for the intake into the folding device and this information is sent by the control unit 119 to the automatic pressure controller 109, taking into consideration that the print sheet may have different values for the left and the right side, depending on the folding pattern.

The illustrated air nozzle 110 is used to blow the air directly onto the print sheet. It is simultaneously taken into consideration that an additional amount of air may be necessary to neutralize the possibly occurring fluttering movements, following the intake of the print sheet 105. Of course, in that case it should also be considered that even after a complete stop of the print sheet 105, an additional introduction of air may be required for stabilizing the print sheet 105.

Thus, the pressure reservoir 111, arranged in the flow direction in front of a pneumatic switching valve, is filled with the pressure controller 109 to the required pressure level.

The print sheet 105 entering/fed into the folding region is detected at the back edge with the aid of a light barrier, not shown in further detail here, wherein this light barrier simultaneously functions to precisely synchronize the clock speed of the folding sword 102, wherein the operation of the light barrier also detects irregularities within the belt transport of the print sheet 105 and compensates these via the control unit 119.

As a result of an activated trigger signal, a signal for activating the pneumatic switching valve is triggered, taking into consideration the dead time and speed compensation.

Following this, the air stored in the pressure reservoir 111 is released abruptly, whereupon the air nozzle 110 releases a pulse-type stream of air that acts upon the print sheet 105.

The released air blast can act directly upon the print sheet 105, or upon a lever (see FIG. 2, Position 112) which transmits the air blast and the corresponding normal force to the print sheet. Of course, a configuration is also conceivable for which the air blast acts upon the print sheet 105 as well as the lever 112, wherein the direct and indirect braking-force introduction can also be controlled by the control unit 119 to be intermittent and with differing pulse strengths of the air pulses (see FIG. 2, Position 114).

During the feeding operation and/or during the folding process, the print sheet 105 is pressed by the triggered pneumatic forces onto the table-type support **106*a*** and generates a braking force for the print sheet as a result of friction.

If necessary, an additional braking force can be directed simultaneously or phase-displaced onto the back edge of the print sheet 105, wherein the material stretching triggered by the braking effect results in a stiffening of the print sheet 105.

The braking instant (see FIG. 3, Position 115) is selected such that the print sheet 105 is securely slowed to 0 and, in an imaginary sense, also when using a print sheet end stop, as described in the above. This specification can also be met if the slowing down of the print sheet 105 to 0 has reached the imaginary stopping point (FIG. 3, Position 113) where the folding sword 102 takes over the print sheet as intended. The takeover of the print sheet 105 by the folding sword 102 can thus be coordinated such that it coincides with the imaginary stopping point 113 of the print sheet end.

Figure 2:
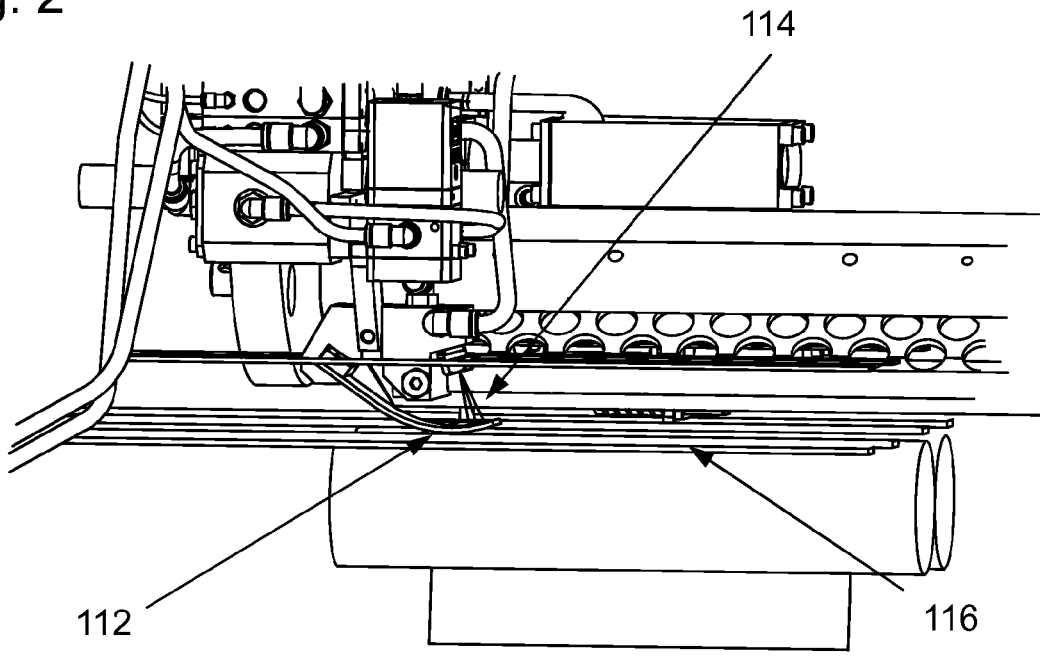
FIG. 2 shows an enlarged area of FIG. 1 with a modification including an intermediary mechanical element used for braking and positioning of the print sheet in connection with applying an air pulse as the braking force according to another embodiment of the invention.

One option for a precisely positioned braking of the print sheet 105, which is not shown further, can be achieved by activating an additional braking force based on friction. This can advantageously be achieved through generating a vacuum that acts upon the underside of the print sheet, wherein this option can without problem also be used together with the other previously explained braking forces. FIG. 2 shows furthermore the folding position 116 of the print sheet 105.

Figure 3:
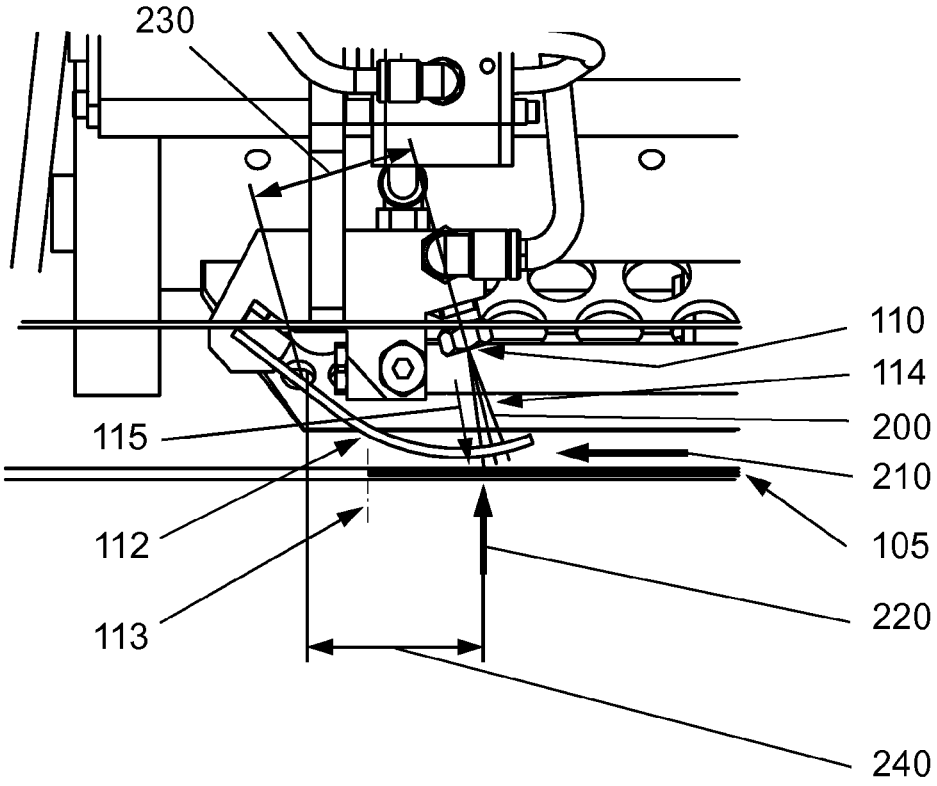
FIG. 3 shows an enlarged area of FIG. 2 and further including geometric conditions and resulting forces during a braking operation.

FIG. 3 shows the geometric conditions and the forces resulting therefrom during the course of decelerating the print sheet. These values, namely the distances 230 and 240, as well as the forces $F_{pulse}$ 200, $F_{braking}$ 210 and $F_{normal}$ 220, which occur during the braking operation, are of a qualitative nature and are used as basis for a controlled braking operation, wherein a parameterizing of these values for a control/regulation of the braking operation is also possible.

Following the release of the air pulses (FIG. 2, Position 114), the pneumatic switching valve is closed immediately and the pressure controller 109 fills the compressed air reservoir 111 again with air to the predetermined pressure level, thus making it available for the next cycle.

Figure 4:
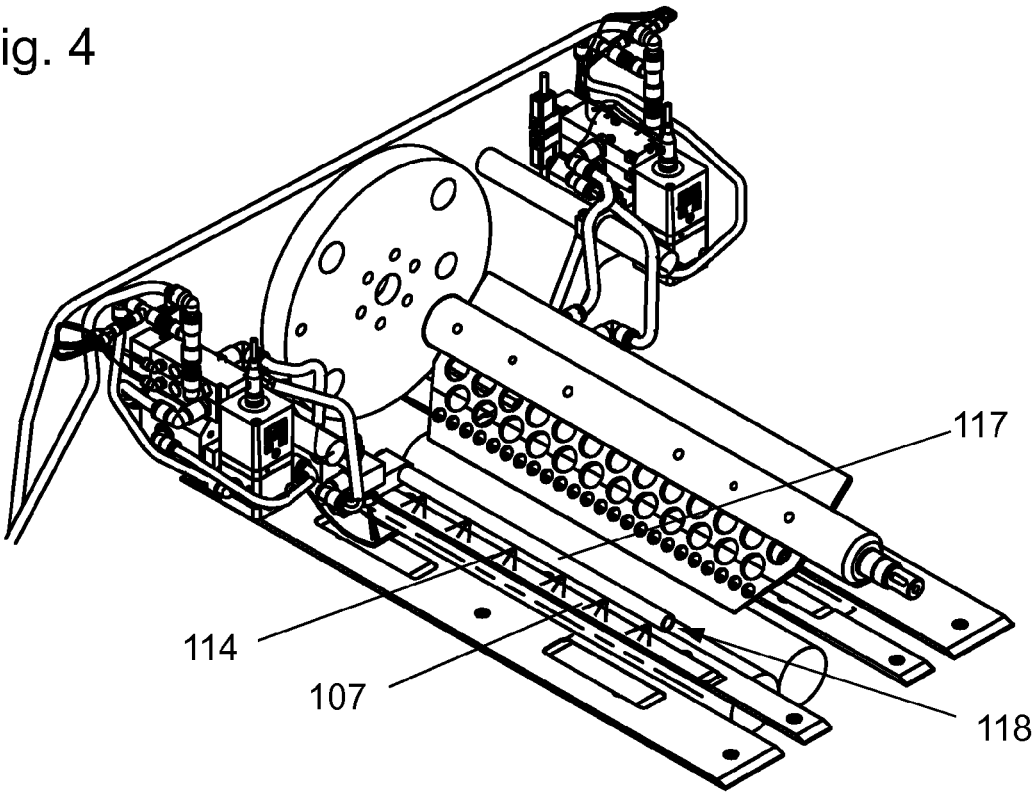
FIG. 4 is a perspective view of a transverse sheet brake that can be activated by air pulses.

FIG. 4 shows a transverse sheet brake 117, which can be activated with several air pulses 114, effective in the end region of the print sheet. For that purpose, the transverse sheet brake 117 is operatively connected to a pipe 118, arranged above this position, which is admitted with air stored in the pressure reservoir (see FIG. 1, Position 111). This transverse sheet brake 117 is capable of stopping the print sheet individually to achieve a precise position and, in addition, to effect a delay to counter strong intake forces and to furthermore start a neutralizing to counter possibly occurring fluttering movements during the folding operation. It is advantageous if this transverse sheet brake 117 that acts upon the print sheet is operated autonomously. If necessary it could be combined with a delay stemming from the vacuum.

Figure 5:
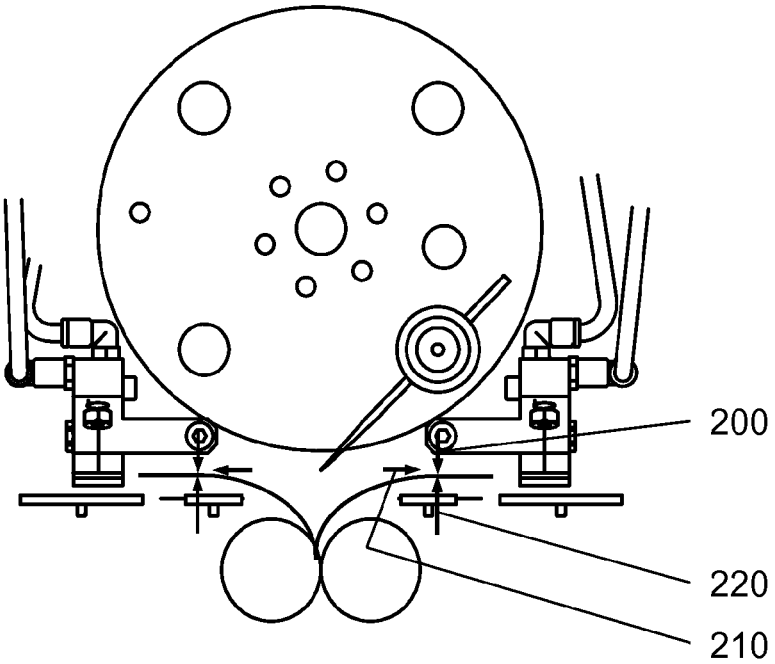
FIG. 5 an end view of a portion of FIG. 4 showing the operational mode of the transverse sheet brake in connection with the intake of the print sheet for the folding operation.

FIG. 5 shows the sequence of steps within the longitudinal folding device 100, relative to the introduced air pulses 200 and the vector direction of the delay forces and/or the braking forces $V_{braking}$ 210 and/or the normal force $F_{normal}$ 220 that develops on the conveying belt.

Figure 6:
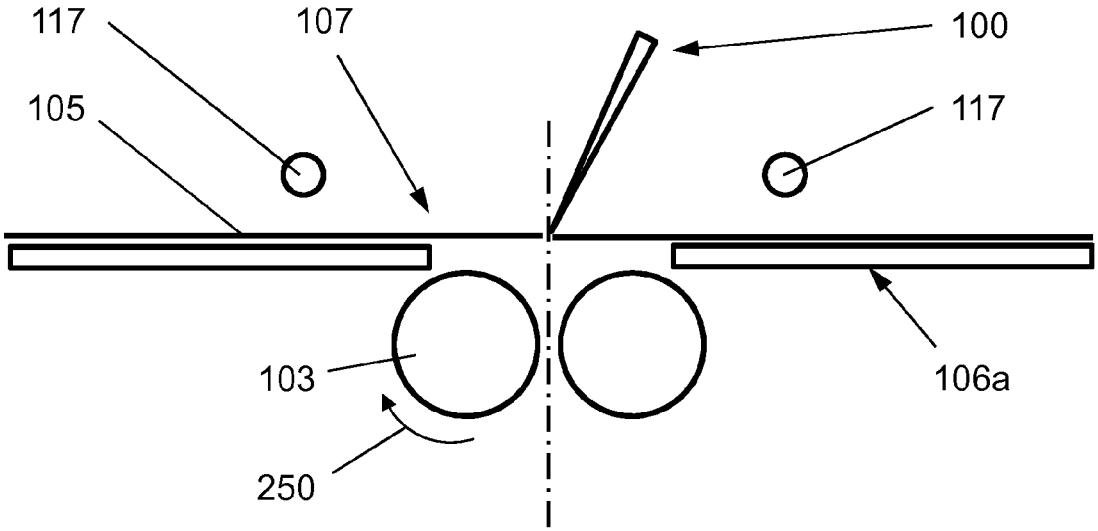
FIG. 6 is a diagram of the course of the folding operation, in a view crosswise to the intake direction of the print sheet.

FIG. 6 shows a schematic course of the folding operation carried out by the longitudinal folding device 100, in a view that is transverse to the intake direction of the print sheet 105, arranged on the table-type support 106*a*. FIG. 6 shows the position occupied by the print sheet 105 before the rollers 103 of the folding device (see also FIG. 1) engage. As can be seen, the pneumatically triggered transverse sheet brakes 117 are effective on both sides of the folding sword 102 (see also FIG. 7), wherein the location and number of transverse sheet brakes shown herein are only of a qualitative nature. The starting point for using the transverse sheet brake 117 directly depends on the start of the intake of the print sheet 105, but need not occur simultaneously. The position 250 characterizes the speed of the folding rollers 103

Figure 7:
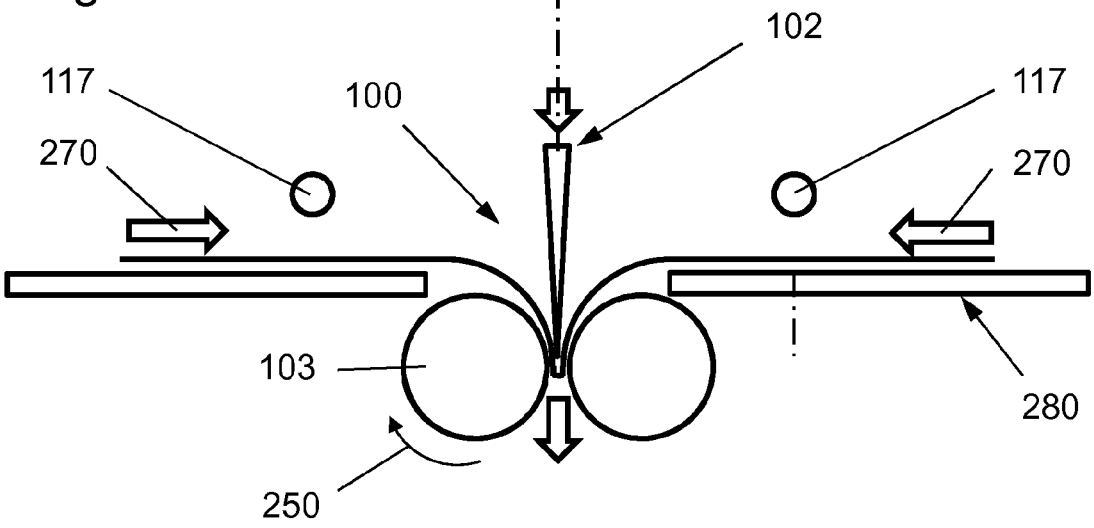
FIG. 7 is a diagram of the course of the folding operation in a position where the print sheet is taken over by the folding rollers.

FIG. 7 shows the schematic sequence of the folding operation at a position where the print sheet 105 is taken over by the folding rollers 103. As can be seen, the pneumatic transverse sheet brakes 117 are effective on both sides of the folding sword 102, wherein the location and number of transverse sheet brakes shown herein are only of a qualitative nature. The operational starting point for the transverse sheet brake 117 therefore is connected to the start of the intake of the print sheet, but must not occur at the same time. In most cases, the transverse sheet brake is first activated at the start of the folding operation. The pulse strength emitted by the transverse sheet brake essentially depends on the initial intake speed $V_{sheet}$ (down arrow; see also FIG. 8 or 9; Position 290) of the print sheet 105 which is a product of $a_{acceleration} \times t_{time}$ 270, wherein it also depends on whether additional braking forces are provided and purposely applied. The speed $V_{sheet}$ 290 of the drawn-in print sheet 105 is equal to the speed of the roller $V_{roller}$. The position 280 illustrates the end of the print sheet 105. The speed of the folding sword 102 is illustrated by the arrow arranged above and pointing downward (without position number).

Figure 8:
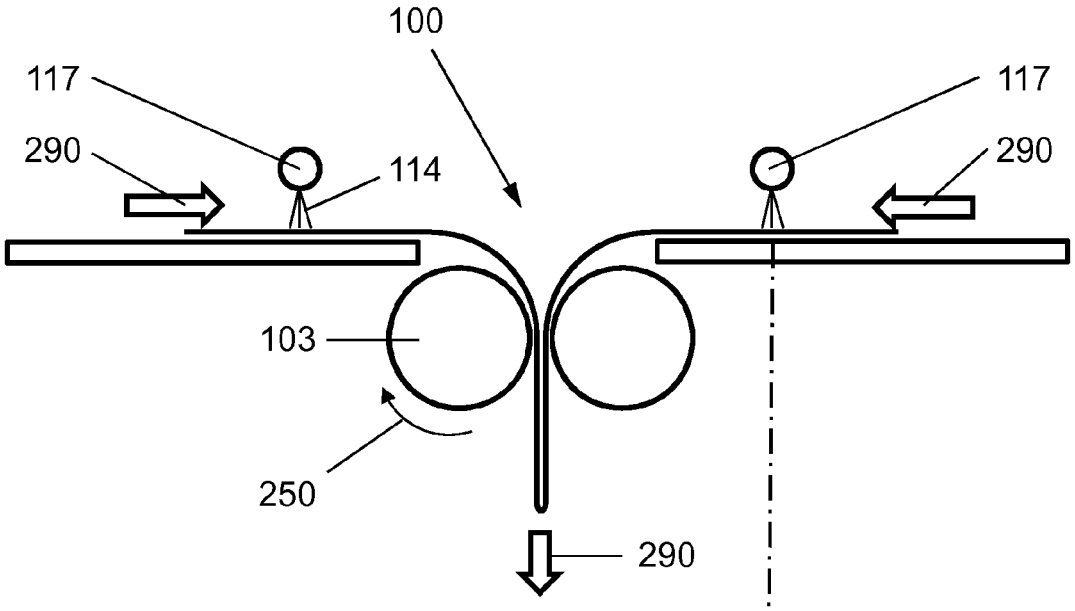
FIG. 8 is a diagram of the course of the folding operation in a position where the transverse sheet brake is activated.

FIG. 8 shows the schematic course of the folding operation in a position where the transverse sheet brake 117 is activated by the illustrated air pulses 114. As can be seen, the pneumatic transverse sheet brakes 117 are effective on both sides of the folding sword 102 (see FIG. 7), wherein the herein shown locations and the number of transverse sheet brakes are of a qualitative nature. The starting point for using the transverse sheet brake 117 depends on the start of the intake of the print sheet 105, but need not occur simultaneously. The pulse strength exerted by the transverse sheet brake essentially depends on the intake speed $V_{sheet}$ 290 of the print sheet 105, which is characterized as $V_{sheet}=V_{roller}$. The speed of the drawn-in print sheet $V_{sheet}$ is therefore equal to the speed of the roller $V_{roller}$. No acceleration takes place during this operation, in contrast to the conditions shown in FIG. 7.

Figure 9:
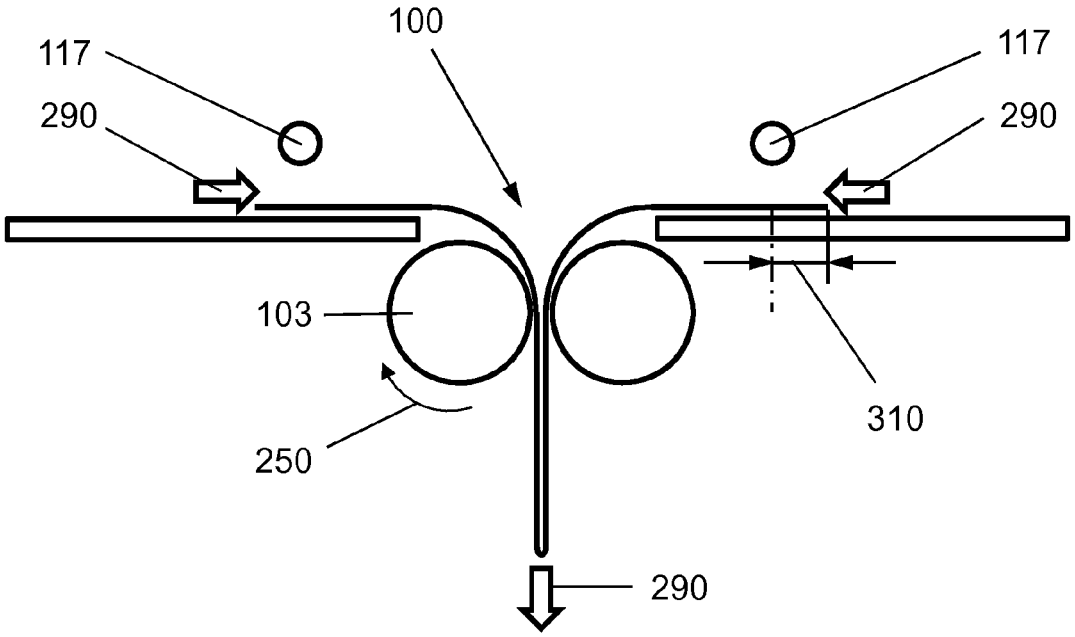
FIG. 9 is a diagram of the course of the folding operation in a position where the transverse sheet brake is deactivated.

FIG. 9 shows the schematic course of the folding operation in a position where the transverse sheet brake 117 is deactivated. According to a preferred embodiment, the transverse sheet brake 117 is deactivated approximately 10 mm before the end of the print sheet intake 310, so that the transverse sheet brake 117 if possible remains active during the complete operation and to ensure that no air below affects the edge of the print sheet during the end phase of the intake, which could cause a damaging lifting up of the edge of the print sheet 105.

The invention has been described in detail with respect to exemplary embodiments, and it will now be apparent from the foregoing to those skilled in the art, that changes and modifications may be made without departing from the invention in its broader aspects, and the invention, therefore, as defined in the appended claims, is intended to cover all such changes and modifications that fall within the true spirit of the invention.

What is claimed is:

1. A device for making available braking forces that act upon a print sheet during a folding operation, wherein the print sheet is in a specified starting position prior to the folding operation, comprising:

a transverse sheet brake operable during a folding operation to generate braking-force triggering one or more pulses that cause intermittent, uniform or oscillating braking forces that act upon at least a section of the print sheet to counter an acceleration of the print sheet that occurs in a starting phase of the folding operation and/or to counter fluttering movements of the print sheet that form during an intake of the print sheet into the folding operation; and a control unit to control the braking-force triggering pulses which is operated based on changeable control profiles resulting from queried operating parameters of production data including at least one of a folding pattern, paper weight, paper width and cut-off length and/or by stored control profiles relating to at least one of said parameters.

2. A method for operating the device according to claim 1 to make available braking forces acting upon a print sheet during a folding operation, wherein the print sheet is in a specified position before reaching the folding operation, comprising:

directing braking-force triggering pulses, that are triggered by the transverse sheet brake toward the print sheet to counter at least one of acceleration of the print sheet that occurs during a starting phase of the folding operation and fluttering movements that form during the intake of the print sheet to the folding operation, wherein the pulses are triggered to act intermittently, uniformly or oscillatingly on at least a section of the print sheet; and controlling the braking-force triggering pulses by the control unit operated with the at least one of changeable control profiles resulting from queried operating parameters and the stored control profiles.

3. The method according to claim 2, including generating the braking-force triggering pulses pneumatically.

4. The method according to claim 2, including transmitting at least one of the intermittent, uniform or oscillating braking-force pulses to the print sheet directly, semi-directly or indirectly.

5. The method according to claim 2, including triggering the braking force pulses mechanically, electronically, hydraulically or pneumatically, and focusing the braking force pulses directly or indirectly onto the print sheet.

6. The method according to claim 2, wherein the braking-force triggering pulses act upon the print sheet to generate an increase in friction between the print sheet and a table support surface.

7. The device according to claim 1, wherein the transverse sheet brake is operative to directly, semi-directly or indirectly transfer the intermittent, uniform or oscillating braking forces to the print sheet.

8. The device according claim 1, further including a table support surface for the print sheet, and the transverse sheet brake is operative to generate braking-force triggering pulses to act upon the print sheet to cause an increase in friction between the print sheet and the table support surface.

9. The device according to claim 1, wherein the transverse sheet brake is operative to supplement at least one braking force acting upon the print sheet during the intake of the print sheet to the folding operation with an additional braking force which acts upon the back edge of the print sheet or is effective in a region of the back edge.

10. A device for making available a braking force that acts upon a print sheet along a feeding direction to a folding operation and during the folding operation, wherein a print sheet is in a specified starting position prior to a folding operation, comprising:

a braking force generating means operative to generate braking force triggering pulses effective along a feeding direction for the print sheet, applied directly or indirectly to the print sheet to exert intermittent, uniform or oscillating braking forces onto the print sheet, while the print sheet is in an operative connection with the folding operation, to position the print sheet in the specified starting position for the folding operation, wherein the braking force triggering pulses are at least one of pneumatic, mechanical and vacuum generated to cause friction to the print sheet;

a transverse sheet brake operative to generate during the folding operation braking-force triggering pulses that cause intermittent, uniform or oscillating braking forces that act upon at least a section of the print sheet to counter an acceleration of the print sheet that occurs in a starting phase of the folding operation and/or to counter fluttering movements of the print sheet during an intake of the print sheet into the folding operation; and a control unit to control all the braking-force triggering pulses, the control unit being operated based on at least one of changeable control profiles resulting from queried operating parameters of production data including at least one of a folding pattern, paper weight, paper width and cut-off length and/or by stored control profiles relating to at least one of said parameters.

11. A method for operating a device according to claim 10 to apply braking-forces to the print sheet along the feeding direction to the folding operation and during a folding operation, comprising:

generating pneumatic, mechanical or vacuum generated braking-force triggering pulses that are effective along the feeding direction of the print sheet, and applying the braking-force generated triggering pulse directly or indirectly to the print sheet to exert the intermittent, uniform or oscillating braking-forces to the print sheet to position the print sheet in the specified starting position for the folding operation; and while the print sheet is subjected to the folding operation, generating braking-force triggering pulses by the transverse sheet brake for causing intermittent, uniform or oscillating braking forces to act on the print sheet to at least one of counter an acceleration of the print sheet that occurs during a starting phase of the folding operation and counter fluttering movements of the print sheet during the folding operation; and controlling the braking-force triggering pulses by the control unit during the intake of the print sheet which is operated based on the at least one of changeable control profiles resulting from queried operating parameters and the stored control profiles.

12. A method of using the device according to claim 10, for braking and positioning a print sheet in a feeding direction and for delaying the print sheet during an intake for a folding operation and/or to counter flattering movements that occur during print sheet intake, the method comprising:

computing an air pressure needed for braking based on a specified production data including at least one of a folding pattern, paper weight, paper width and cut-off length, and sending an information regarding the computed pressure to an automatic pressure controller, taking into consideration the print sheet has different values on the left and right side based on a folding pattern;

computing the air pressure required for slowing down the print sheet during intake into the folding station and/or to counter the flattering movements based on specified production data including at least one of the folding pattern, paper weight, paper width and cut-off length, and sending an information regarding the computed air pressure to an automatic pressure controller, taking into consideration that the left and right side of the print sheet have different values, depending on the folding pattern for the print sheet;

filling a pressure reservoir located in front of a pneumatic switching valve in the flow direction with the computed pressure;

detecting the print sheet entering or fed into a folding region by a light barrier along the back edge of the print sheet, wherein the light barrier simultaneously serves to ensure a synchronizing of a folding sword with a precise clock speed, and the light barrier detects irregularities within the belt transport of the print sheet and compensates for the irregularities with the control unit;

triggering a signal for activating a pneumatic switching valve based on an activated trigger signal, taking into consideration a dead time and speed compensation;

following the triggering, releasing abruptly the air stored in the pressure reservoir to cause an air nozzle to release a pulse-type air blast;

transmitting the released air blast directly onto the print sheet or indirectly to a lever, which transmits a force of the air blast and the corresponding normal force onto the print sheet;

pressing the print sheet during the feeding operation and/or during the folding process onto a table-type support and generating a braking force for the print sheet as a result of friction;

exerting simultaneously or with a phase delay an additional braking force onto the back edge of the print sheet, wherein a material stretching results from the braking operation to cause stiffening of the print sheet;

selecting the stopping instant such that the print sheet is braked securely to 0, or fits uniformly against the sheet end stop, or the folding sword takes over the print sheet or it is delayed during the folding process; and following release of the air pulses, closing the pneumatic switching valve immediately and filling the air reservoir again by the pressure controller with air to a predetermined pressure level to make air available for a following cycle.

13. The device according to claim 10, wherein the transverse sheet brake is operative to directly, semi-directly or indirectly transfer the intermittent, uniform or oscillating braking forces to the print sheet.

14. The device according to claim 10, wherein the brake-force generating means includes mechanical, electronic, hydraulic or pneumatic means to generate the braking forces which are focused directly or indirectly onto the print sheet.

15. The device according claim 10, further including a table support surface for the print sheet, and wherein the brake-force generating means is operative to generate braking-force triggering pulses to act upon the print sheet to cause an increase in friction between the print sheet and the table support surface.

16. The device according to claim 15, wherein the brake-force generating means generates a vacuum which acts in a feeding direction of the print sheet to the folding operation and upon an underside of the print sheet to increase a friction between the underside of the print sheet and the table support surface.

17. The device according to claim 10, wherein the brake-force generating means includes means to supplement at least one braking force acting upon the print sheet during an intake of the print sheet to the folding operation with an additional braking force which acts upon a back edge of the print sheet or is effective in a region of the back edge.

18. The device according to claim 10, wherein the brake-force generating means includes means to generate and apply at least one braking force in connection with forming an overlapping flow or separating sheets from an overlapping flow in a feeding direction of the transported print sheets.

19. The device according to claim 10, wherein the brake-force generating means generates at least one pneumatically driven braking force and further including at least one switching valve having a nozzle to control the at least one pneumatically driven braking force as a function of a feeding speed and texture of the print sheet.

20. The method according to claim 11, wherein the braking-force triggering pulses are generated pneumatically.

21. The method according to claim 11, including transmitting at least one of the intermittent, uniform or oscillating braking-force pulses to the print sheet directly, semi-directly or indirectly.

22. The method according to claim 11, including triggering the braking force pulses mechanically, electronically, hydraulically or pneumatically, and focusing the braking force pulses directly or indirectly onto the print sheet.

23. The method according to claim 11, wherein the braking-force triggering pulses act upon the print sheet to generate an increase in friction between the print sheet and a table support surface.

24. The method according to claim 11, including generating a vacuum which acts upon an underside of the print sheet to increase friction on the print sheet in the feeding direction.

25. The method according to claim 11, including supplementing at least one of the braking forces acting upon the print sheet during the feeding of the print sheet with an additional braking force which acts upon a back edge or back edge region of the print sheet.

26. The method according to claim 11, including using at least one braking force to form an overlapping flow of the print sheets transported in the feeding direction or separating sheets out of an overlapping flow.

27. The method according to claim 11, including controlling at least one pneumatic braking force with at least one nozzle of a switching valve, taking into consideration at least one of a feeding speed and a texture of the print sheet.

28. A device for making available braking forces that act upon a print sheet along a feeding direction to a folding operation and during the folding operation, wherein the print sheet is in a specified starting position prior to the folding operation, comprising:

a braking force generating means operative to generate braking force triggering pulses effective along a feeding direction for the print sheet, applied directly or indirectly to the print sheet to exert intermittent, uniform or oscillating braking forces onto the print sheet, while the print sheet is in an operative connection with the folding operation, to position the print sheet in the specified starting position for the folding operation, wherein the braking force generating means comprises at least one of a vacuum generator to generate a vacuum acting upon the print sheet and at least one mechanical element, to bring the print sheet to a standstill at the specified starting position;

a transverse sheet brake operative to generate during the folding operation braking-force triggering pulses that cause intermittent, uniform or oscillating braking forces that act upon at least a section of the print sheet to counter an acceleration of the print sheet that occurs in a starting phase of the folding operation and/or to counter fluttering movements of the print sheet during an intake of the print sheet into the folding operation; and a control unit to control all the braking-force triggering pulses, the control unit being operated based on at least one of changeable control profiles resulting from queried operating parameters of production data including at least one of a folding pattern, paper weight, paper width and cut-off length and/or by stored control profiles relating to at least one of said parameters.

* * * * *